US005564820A

United States Patent [19]

Entrop et al.

[11] Patent Number: 5,564,820

[45] Date of Patent: Oct. 15, 1996

[54] LUMINAIRE

[75] Inventors: Jean P. Entrop; Hendrik Wijbenga, both of Eindhoven, Netherlands

[73] Assignee: U.S. Philips Corporation, New York, N.Y.

[21] Appl. No.: 273,546

[22] Filed: Jul. 11, 1994

Related U.S. Application Data

[63] Continuation of Ser. No. 28,465, Mar. 9, 1993, abandoned.

[30] Foreign Application Priority Data

Mar. 16, 1992 [EP] European Pat. Off. ..... 92200741

[51] Int. Cl.[6] ..... F21V 11/02

[52] U.S. Cl. ..... 362/362; 362/310; 362/342; 362/375

[58] Field of Search ..... 362/290, 310, 362/342, 354, 362, 375

[56] References Cited

U.S. PATENT DOCUMENTS

| | | | |
|---|---|---|---|
| 1,508,223 | 9/1924 | Hartmann | 362/342 |
| 4,538,217 | 8/1985 | Ewing et al. | 362/310 |

FOREIGN PATENT DOCUMENTS

| | | | |
|---|---|---|---|
| 826469 | 1/1952 | Germany | 362/290 |
| 7601614 | 7/1976 | Germany . | |
| 677398 | 5/1991 | Switzerland . | |
| 167554 | 8/1921 | United Kingdom | 362/290 |

*Primary Examiner*—Leonard E. Heyman
*Attorney, Agent, or Firm*—Brian J. Wieghaus

[57] ABSTRACT

A luminaire includes a reflector in a housing, a lampholder for accommodating an electric lamp parallel to a light-emission window of the housing and to second sides thereof, and a light transmissive pane closing the window. Light-screening lamellae are present near the window, transverse to the main direction of the lamp. The luminaire has lamellae in regions adjacent first sides of the window, only; a central region of the window being free of lamellae for allowing easy replacement of the lamp through the central region not occupied by the lamellae. In an embodiment of the luminaire the lamellae are not linked to the pane. The luminaire allows for an easy replacement of the lamp and easy cleaning of the pane. An increased light output is obtained, too.

10 Claims, 2 Drawing Sheets

LUMINAIRE

This is a continuation of U.S. application Ser. No. 08/028,465, filed on Mar. 9, 1993 now abandoned.

BACKGROUND OF THE INVENTION

The invention relates to a luminaire comprising:

a housing provided with a reflector and with a light emission window with first and second mutually opposing sides;

a lampholder in the housing for accommodating an electric lamp inside the reflector alongside the emission window, alongside the second sides thereof;

a pane closing the emission window; and several lamellae near the light emission window along the first sides thereof, transverse to the pane.

Such a luminaire is known from DE-GM 76 01 614.

The known luminaire has a raster of parallel lamellae coupled to the pane. The object of the raster is to prevent glare at comparatively wide angles to the perpendicular of the pane.

A disadvantage of the lamellae attachment near the light emission window is that the raster must be removed for exchanging a defective lamp. This disadvantage is counteracted in the known luminaire in that the raster is coupled to the pane. When the housing is opened, the lamp becomes immediately accessible.

Coupling of the raster to the pane, however, has the disadvantage that cleaning of the pane is difficult and requires much time because the pane is not readily accessible.

SUMMARY OF THE INVENTION

It is an object of the invention to provide a luminaire of the kind described in the opening paragraph which is of a construction which renders an enclosed lamp easily accessible for exchange and in which cleaning of the pane is also rendered easier.

According to the invention, this object is achieved in that the lamellae are present only in regions adjacent the first sides of the emission window.

It was found that it is not necessary for lamellae to be present over the entire light emission window for the restriction of the angles to the perpendicular on the pane at which high brightnesses in the luminaire can be observed during operation. If such lamellae are present only in regions at the first sides, and are accordingly absent in the interposed central region, it is already achieved that high brightnesses of the lamp accommodated in the luminaire and of the reflector cannot be observed at great angles.

The measure in the luminaire according to the invention has the result that cleaning of the pane in the case in which the lamellae are coupled thereto is much less time-consuming.

In a favourable embodiment of the luminaire, the lamellae are uncoupled from the pane. The lamellae are then fastened, for example, to the reflector or to the housing. The pane can then be cleaned very easily at both its surfaces.

Coupling of the lamellae to the housing, possibly by way of the reflector, provides a very reliable position of the lamellae relative to the reflector and the lamp.

The absence of lamellae in the central region of the light emission window renders it possible to insert or remove a lamp through the central region, in between the lamellae of the two regions adjacent the first sides. Depending on the geometric relations between the lamp and the luminaire, it may be necessary during this to move the lamp into or from the housing parallel to the lamellae.

An additional favourable property of the luminaire is that the absence of lamellae in the central region results in an increase in the luminous flux from the luminaire.

BRIEF DESCRIPTION OF THE DRAWING

An embodiment of the luminaire according to the invention is shown in the drawing. Therein is.

DESCRIPTION OF THE PREFERRED EMBODIMENT

Figure 1:
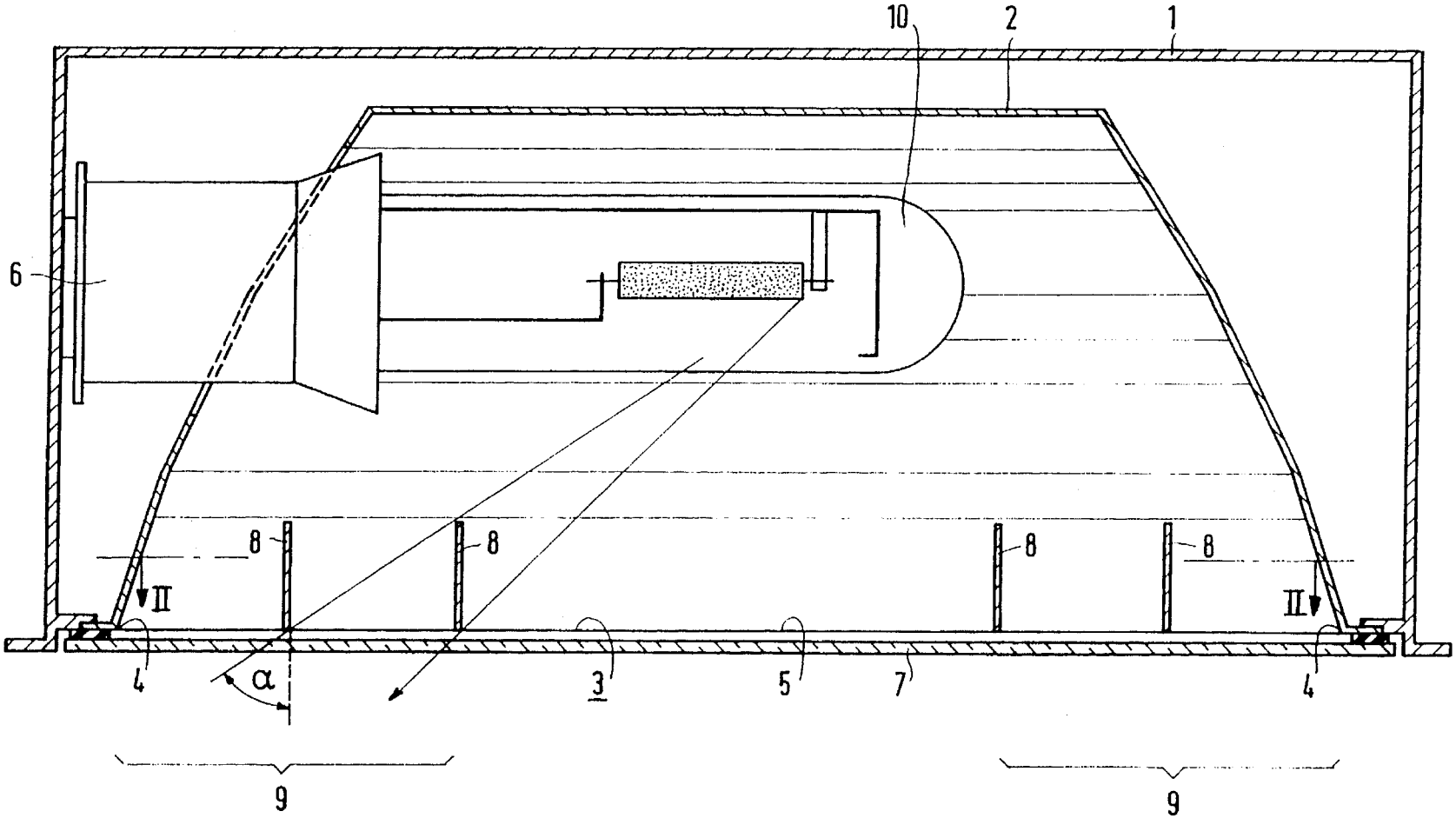
FIG. 1 a longitudinal cross-section.
Figure 2:
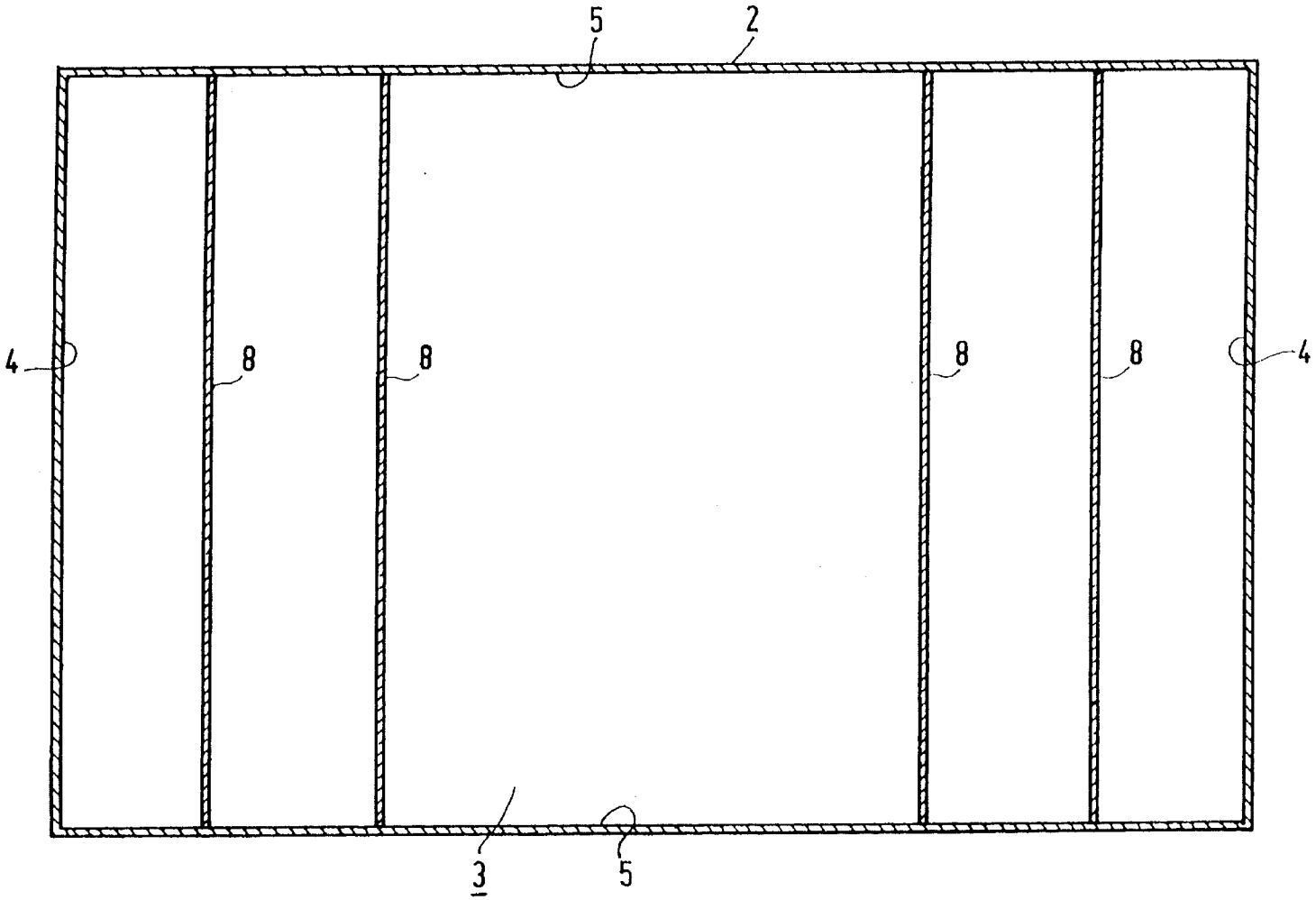
FIG. 2 a cross-section according to II—II in FIG. 1.

In the drawings, the luminaire has a housing 1 provided with a reflector 2 and with a light emission window 3 with first 4 and second 5 mutually opposing sides. A lampholder 6, an E-40 holder in FIG. 1, is present in the housing for accommodating an electric lamp 10 inside the reflector alongside the emission window, along the second sides thereof. A pane 7 closes the emission window. Several lamellae 8 are arranged near the light emission window along the first sides thereof, transverse to the pane.

The lamellae 8 are present only in regions 9 adjacent the first sides of the light emission window. They are uncoupled from the pane 7.

In the Figure, the lamp is a high-pressure sodium discharge lamp which consumes a power of 250 W during operation.

The lamellae 8 in the luminaire drawn are fastened to the reflector. The lamp can be removed from the luminaire through the central region of the emission window between the regions 9. The pane 7 is free from lamellae and can as a result be easily cleaned at both its surfaces. In the case of a conventional arrangement of lamellae, two more lamellae would be present in the central region with a mutual interspacing and a distance from the drawn lamellae equal to the interspacings of the lamellae in each of the regions 9.

The lamellae 8 prevent an observer from looking into the lamp or from observing high brightnesses coming from the reflector at an angle in excess of an angle $\alpha$. The luminaire shown is designed for recessed mounting into a false ceiling.

We claim:

1. A luminaire comprising:

a housing having a reflector and a planar light emission window opposite the reflector, the window having an outer perimeter defining a plane of the light emission window;

a lampholder for holding an electric lamp inside the housing completely between the reflector and the window, said housing being closed and opaque such that light from a lamp held in said lamp holder is emitted from said housing substantially only through said light emission window, said housing screening light emitted from a lamp held in the lamp holder and reflector at a first acute angle measured from the plane of the light emission window;

a light-transmissive pane closing the light emission window, and pane being displaceable away from the light emission window; and a plurality of light-screening lamellae fixed to at least one of the housing and the reflector and extending between the lampholder and the pane, the lamellae extending generally transversely to the pane for screening light emitted from the lamp and reflector in a selected direction from the lamp at a second acute angle, measured from the plane of the light emission window, larger than said angle, the lamellae being non-adjustable in directions along the plane of the emission window and being present only in regions adjacent the perimeter of the light emission window and not in a central region of the window, the central region being sufficiently sized for permitting an electric lamp to be removed from and inserted into the lampholder through the central region not occupied by the lamellae upon displacement of the pane away from the window, without removal of the lamellae from the housing.

2. A luminaire according to claim 1, wherein:

the light emission window is rectangular and the perimeter thereof includes a first pair of opposing sides and a second pair of opposing sides;

the lampholder is arranges for holding an electric lamp with the longitudinal axis of the lamp extending parallel to the second sides and the light emission window; and the lamellae extend longitudinally only between the sides of the second pair of sides and only in regions adjacent each side of the first pair of sides.

3. A luminaire according to claim 2, futher including an electric lamp held on said lampholder and having a longitudinal axis extending parallel to said pane and said second sides.

4. A luminaire according to claim 1, futher including an electric lamp held in said lampholder and having a longitudinal axis extending parallel to said pane and said second sides.

5. A luminaire, comprising:

a housing having a main wall and a plurality of side walls extending generally transverse to said main wall, said side walls defining a light emissison window opposite said main wall, the light-emission window having an outer perimeter defining a plane of the light emission window;

a flat, planer light-transmissive pane closing the light emission window, the pane being displaceable away from the light emission window in a direction away from said main wall;

a lampholder between said main wall and said pane for holding an electric lamp inside said housing between said main wall and said pane;

an electric lamp having a lamp axis, a base end and a distal end, said lamp being held with said base end in said lampholder with the lamp axis of the lamp extending parallel to and spaced from said light emission window and said pane;

said main and side walls being closed and opaque such that light from said lamp is emitted from said housing substantially only through said light emission window, said side walls screening light emitted from said electric lamp and housing in the axial direction of said lamp at a first acute angle measured from the plane of said light emission window; and a plurality of light-screening lamellae, fixed relative to said housing, disposed between the lampholder and said pane, and extending transverse to said lamp axis, said plurality including at least a first pair of lamellae adjacent said lamp base and a second pair adjacent said distal end of said lamp for screening light emitted from the lamp and housing in the axial direction of the lamp at a second acute angle measured from the plane of the light emission window larger than said first angle, the lamellae not being present in a central region of the window, the central region being sufficiently sized for permitting the electric lamp to be removed from and inserted into the lampholder through the central region not occupied by the lamellae upon displacement of the pane away from the window, without displacement of the lamellae.

6. A luminaire according to claim 5, wherein:

the light emission window is rectangular and said plurality of side walls includes a first pair of opposing sides and a second pair of opposing sides orthogonal to said first pair of sides;

the lampholder is arranged for holding an electric lamp with the axis extending parallel to the second sides; and the lamellae extend longitudinally only between the sides of the second pair of sides and only in a region adjacent each of the first pair of sides.

7. A luminaire according to claim 6, further comprising a reflector positioned between the lampholder and said main wall for reflecting light from said electric lamp out through said light emission window.

8. a luminaire according to claim 5, futher comprising a reflector positioned between the lampholder and said main wall for reflecting light from said electric lamp out through said light emission window.

9. A luminaire for being recessed in a ceiling, comprising:

a housing having a main wall, a first pair of opposing side walls and a second pair of opposing side walls orthogonal to said first side walls, said side walls extending transversely to said main wall and defining a rectangular light emission window opposite said main wall;

a flat, planar light-transmissive pane closing the light emission window, the pane being displaceable away from the light emission window in a direction away from said main wall, the light emission window and said pane being substantially flush with the ceiling when said luminaire is mounted in said ceiling;

a lampholder betweer said main wall and said pane for holding an electric lamp inside said housing between said main wall and said pane;

an electric lamp having a lamp axis, a base end and a distal end, said lamp being held with said base end in said lampholder with the lamp axis of the lamp extending parallel to and spaced from said light emission window ans said pane and parallel to said second sides;

said main and side walls being closed ans opaque such that light from said lamp is emitted from said housing only through said light emission window, said walls screening light emitted from said electric lamp and housing in the axial direction of said lamp at a first acute angle measured from said light emission window and the ceiling; and a plurality of light-screening lamellae, fixed relative to said housing, dispoaed between the lampholder and said pane, and extending generally transverse to said lamp axis, said plurality including at least a first pair of lamellae adjacent said lamp base and a second pair of lamellae adjacent said distal end of said lamp for screening light emitted from the lamp and housing in the axial direction of the lamp at a second acute angle, measured from the light emission window, larger than said first angle, the lamellae not being present in a central region of the window, the central region being sufficiently sized for permitting the electric lamp to be removed from and inserted into the lampholder through the central region not occupied by the lamellae upon displacement of the pane away from the window, without displacement of the lamellae.

10. A lamp fixture for an electric lamp having a lamp axis, a base end and a distal end, said fixture comprising:

a housing having a main wall and a plurality of side walls extending generally transverse to said main walls, said side walls defining a planar light emission window opposite said main wall, the light-emission window having an outer perimeter defining a plane of the light emission window;

a light-transmissive pane closing the light emission window, the pane being displaceable away from the light emission window and away from said main wall;

a lampholder for holding the base end of the lamp, the lampholder being disposed between said main wall and said pane for holding the electric lamp inside said housing between said main wall and said pane with the lamp axis of the lamp extending parallel to and spaced from said light emission window and said pane;

said main and side walls being closed and opaque such that light from the lamp, when held in the lampholder, is emitted from said housing substantially only through said light emission window, said side walls screening light emitted from the electric lamp and housing in the axial direction of the lamp at a first acute angle measured from the plane of said light emission window; and a plurality of light-screening lamellae, fixed relative to said housing and said reflector, disposed between the lampholder and said pane, and extending generally transverse to said lamp axis, said plurality including at least a first pair of lamellae adjacent said lampholder and a second pair opposite the lampholder for screening light emitted from the lamp and housing in the axial direction of the lamp at a second acute angle measured from the plane of the light emission window larger than said first angle, the lamellae not being present in a central region of the window, the central region being sufficiently sized for permitting the electric lamp to be removed from and inserted into the lampholder through the central region not occupied by the lamellae upon displacement of the pane away from the window, without displacement of the lamellae.

* * * * *